US005173674A

United States Patent [19]

Pannenborg et al.

[11] Patent Number: 5,173,674

[45] Date of Patent: Dec. 22, 1992

[54] THERMAL-MAGNETIC TRIP UNIT WITH LOW CURRENT RESPONSE

[75] Inventors: Erich J. Pannenborg; Joseph M. Palmieri, both of Southington; Raymond K. Seymour, Plainville, all of Conn.

[73] Assignee: General Electric Company, New York, N.Y.

[21] Appl. No.: 841,182

[22] Filed: Feb. 25, 1992

[51] Int. Cl.[5] ..... H01H 75/12

[52] U.S. Cl. ..... 335/35; 335/23

[58] Field of Search ..... 335/167-176, 335/23-25, 35, 36-38, 43

[56] References Cited

U.S. PATENT DOCUMENTS

| | | | |
|---|---|---|---|
| 2,902,560 | 9/1959 | Stanback et al. | 335/35 |
| 3,179,767 | 4/1965 | Middendorf . | |
| 3,256,407 | 6/1966 | Klein | 333/35 |
| 3,264,427 | 8/1966 | Hurtle | 335/35 |
| 3,278,707 | 10/1966 | Klein . | |
| 3,278,708 | 10/1966 | Klein . | |
| 3,401,363 | 9/1968 | Vyskocil et al. | 335/35 |
| 3,743,981 | 7/1973 | Geleziunas | 335/23 |
| 4,081,852 | 3/1978 | Coley et al. | 361/45 |
| 4,459,572 | 7/1984 | Fajner et al. | 335/16 |
| 4,513,268 | 4/1985 | Seymour et al. . | |
| 4,951,015 | 8/1990 | Shea et al. . | |

*Primary Examiner*—Lincoln Donovan
*Attorney, Agent, or Firm*—Richard A. Menelly

[57] ABSTRACT

A molded case thermal-magnetic circuit breaker having improved low current magnetic trip response pivotally arranges the magnet within the circuit breaker thermal-magnetic trip system for controllably moving toward the latching armature assembly. The movement of the magnet decreases the magnetic separation distance between the magnet and the latching armature to optimize the magnetic trip forces and thereby enhance low current magnetic trip response.

22 Claims, 8 Drawing Sheets

THERMAL-MAGNETIC TRIP UNIT WITH LOW CURRENT RESPONSE

BACKGROUND OF THE INVENTION

Thermal-magnetic trip units used within residential and commercial molded case circuit breakers are generally limited by geometric considerations from providing low current magnetic trip response. U.S. Pat. No. 4,513,268 describes a residential type molded case circuit breaker incorporating a thermal-magnetic trip unit in accordance with the prior art. U.S. Pat. No. 4,951,015 describes a movable core that is designed to move into the gap existing between the core and armature of a magnetic trip unit to reduce the primary air gap and increase the magnetic flux. The movable core effectively allows the circuit breaker to trip at lower current levels. U.S. Pat. Nos. 3,179,767, 3,278,707 and 3,278,708 each describe the use of an additional turn of wire around the magnet used within the thermal-magnetic trip unit to increase the magnetic forces on the armature at low currents.

Additionally, U.S. patent application entitled "Thermal-Magnetic Trip Unit" Ser. No. 07-841180 describes a pivotally-arranged intermediate armature assembled between the latching armature and fixed magnet used within residential circuit breaker thermal-magnetic trip units. The additional intermediate armature correspondingly decreases the magnetic separation gap between the magnet and latching armature to increase the magnetic trip response.

One purpose of the invention is to provide a circuit breaker low cost thermal-magnetic trip unit having improved low current trip response without requiring an additional armature or any substantial changes to the circuit breaker trip unit.

SUMMARY OF THE INVENTION

The invention comprises a thermal-magnetic trip unit of the type employing a movable magnet structure and a movable latching armature that move toward each other in proportion to overload circuit currents. The bimetal element is positioned between the magnet and the latching armature and is electrically connected in series with the circuit current. Magnetic forces induced within the magnet attract the movable latching armature to interrupt the circuit current upon occurrence of an extreme overload current. To increase the magnetic forces, the magnet first moves toward the latching armature to decrease the magnetic gap separation distance, before the latching armature responds to interrupt the circuit current.

DESCRIPTION OF THE PREFERRED EMBODIMENT

Figure 1:
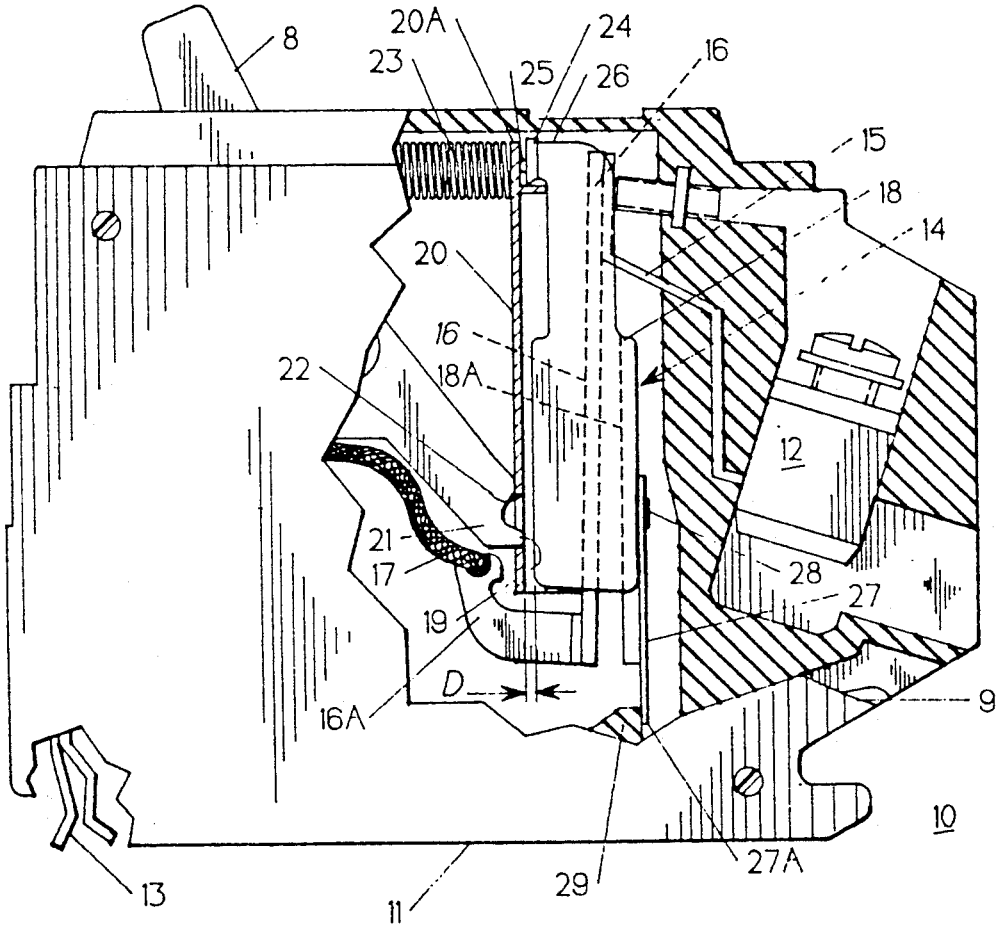
FIG. 1 is a side view of a residential circuit breaker with the cover partially removed to depict the thermal-magnetic trip unit according to the invention.

A residential molded case circuit breaker 10 is shown in FIG. 1 and consists of a molded plastic case 11 to which a molded plastic cover 9 is fixedly attached. The circuit breaker is turned between its 0N and OFF conditions by means of the circuit breaker operating handle 8. As described in the aforementioned U S. Pat. No. 4,513,268, external electrical connection is made by means of the terminal lug 12 at the load end of the breaker and with the line terminal 13 extending from the bottom part of the line end of the circuit breaker. The occurrence of an overcurrent condition within an associated electrical distribution circuit is determined within the thermal-magnetic trip unit 14 which connects with the load terminal by means of the load strap 15. The load strap connects with the bimetal element 16 which in turn connects with the circuit breaker movable contact arm by means of the braided conductor 17 and tab 16A. The electric current through the bimetal induces an electromagnetic force within the magnet 18 that partially encompasses the bimetal. As further described within the aforementioned U.S. Pat. No. 4,513,268, a latching armature 20 supports the hook 19 on the end of the releasable element 21 within the latching slot 22 formed in the bottom part of the latching armature. The latching armature 20 and the magnet 18 are pivotally arranged at the top of the circuit breaker case and are held together by means of the tension spring 23. In order to reduce adverse vibration effects, and to allow for independent rotation of the magnet, a protrusion 25 formed on the plate 24 on the hook-shaped end 26 of the magnet interfaces with the top end 20A of the latching armature 20. The protrusion 25 between the magnet and the latching armature reduces vibration effects by reducing the contribution of the mass of the magnet to that of the latching armature. Heretofore, when the end of the magnet was flush with the end of the armature, the tension provided by the compression spring coupled the mass of the magnet to that of the armature such that the magnet and armature moved as a single unit when the circuit breaker was subjected to vibration impact tests in an attempt to mechanically dislodge the latching armature 20 from the releasable element 21. The interaction between the latch and magnet by means of the spring is substantially reduced by providing a pivot connection between the latch and the magnet by the arrangement of the protrusion 25 below the line of action of the spring force identified by the arrow F in FIG. 5. In accordance with the teachings of the invention, a linear spring 27 is attached to the rear of the magnetic side piece 18A by means of rivets 28 or other suitable fasteners. The end of the spring, as indicated at 27A, abuts a projection 29 integrally formed within the circuit breaker case 11. The location of the spring is selected to set the magnetic gap separation distance D as defined between the interface surfaces on the latching armature 20 and the magnet 18. As more clearly described within the U.S. patent application Ser. No. 07-841,180, the magnetic gap separation distance determines the intensity of the magnetic forces generated between the magnet and the latching armature when a magnetic field is induced within the magnet by transfer of circuit current through the current path defined by the load terminal lug 12, load strap 15, bimetal 16 and the flexible braid conductor 17.

Figure 2:
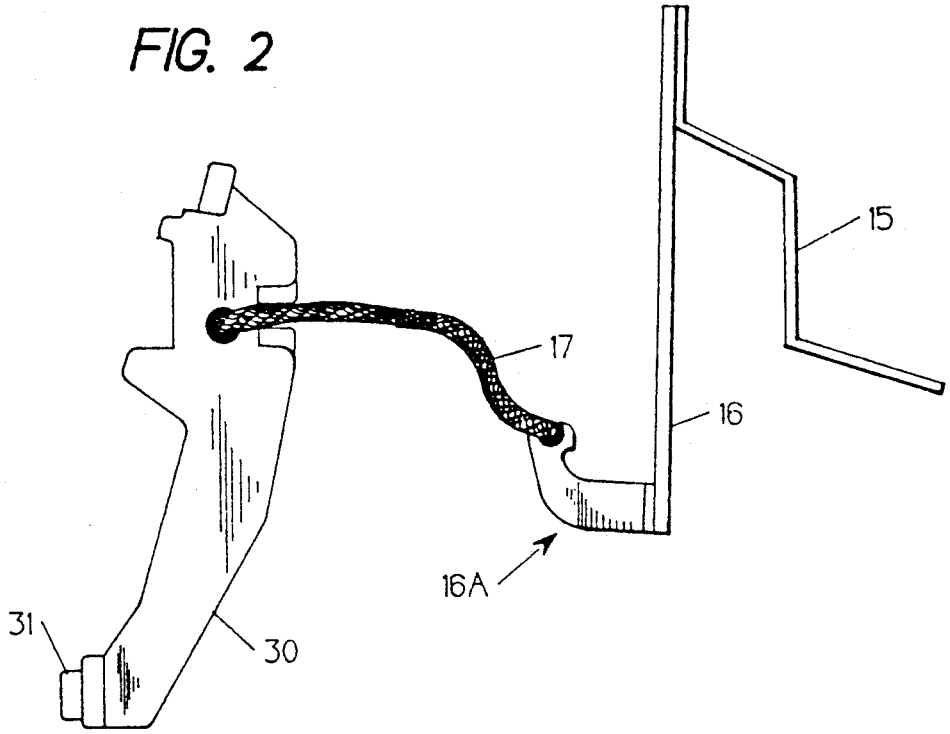
FIG. 2 is a side view of the current path assembly within the thermal-magnetic trip unit of FIG. 1.

The magnetic current path is best seen by referring now to FIG. 2, wherein the load strap 15 is depicted as welded or brazed to the top part of the bimetal 16. The bimetal is attached to the movable braid conductor 17 by means of the off-set tab 16A attached to the bottom of the bimetal and the braid conductor 17 is either welded or brazed to the movable contact arm 30 which contains the movable contact 31 at one end.

Figure 3:
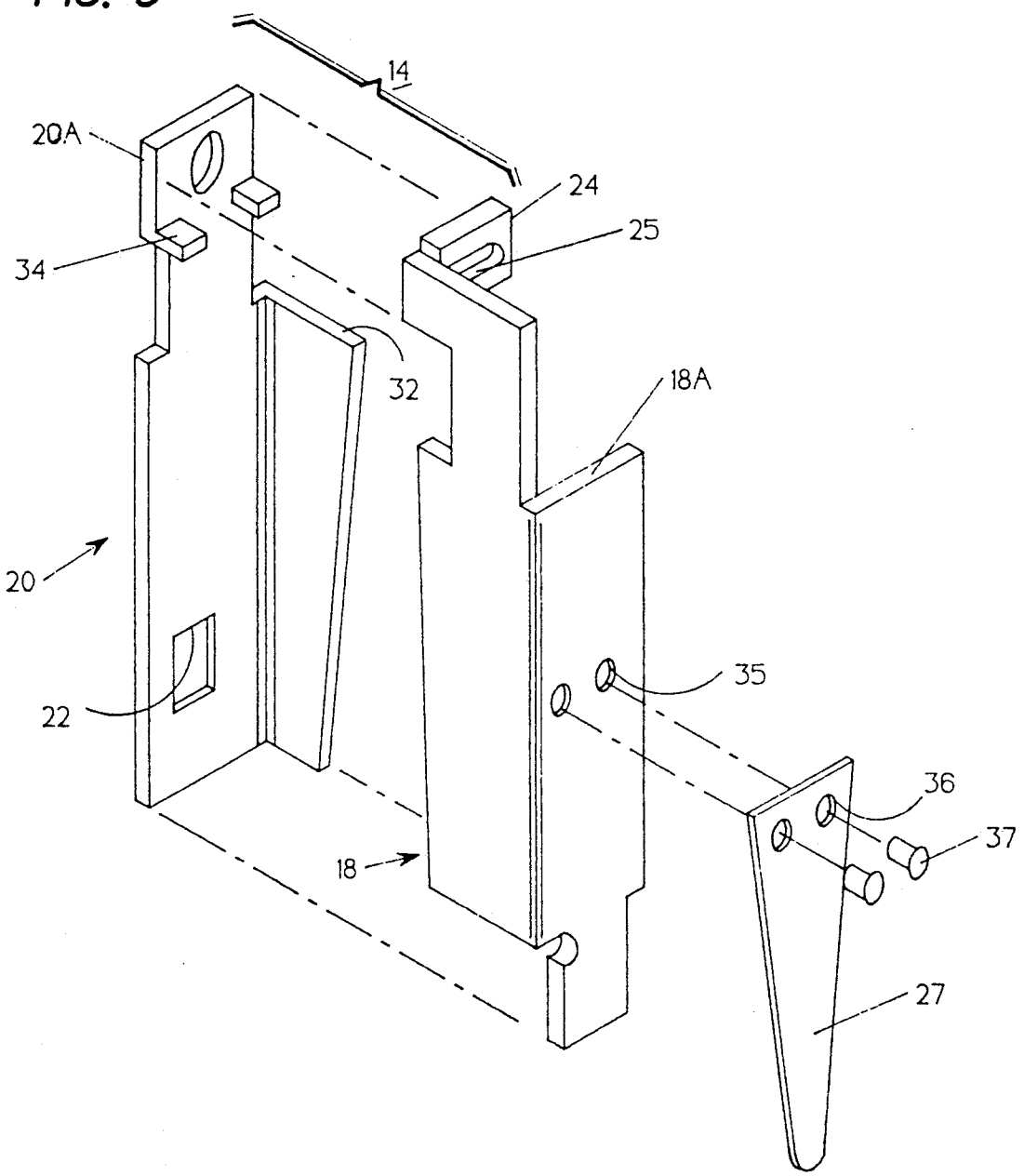
FIG. 3 is an enlarged top perspective view of the thermal-magnetic trip unit of FIG. 1 prior to assembly.

The trip unit 14 is depicted in FIG. 3 prior to arranging the magnet 18 and the latching armature 20 about the bimetal 16 (FIG. 2) such that the top plate 24 of the magnet rests upon the off-set tabs 34 formed in the top 20A of the latching armature 20. The projection 25 interfaces with the top of the latching armature in the manner described earlier. The arrangement of the top plate 24 on the off-set tabs 34 allows the magnet to pivot in the direction of the latching armature The magnet side piece 18A cooperates with the side piece 32 formed on the latching armature to form a "closed" magnetic coupling between the latching armature and the magnet for efficiently intercepting the electromagnetic field produced by the circuit current transport through the bimetal. As shown earlier in FIG. 1, the rectangular slot 22 formed in the bottom part of the latching armature 20 receives the hook 19 formed at the end of the latching element 21 to restrain the circuit breaker operating mechanism from interrupting circuit current during quiescent current operating conditions. In further accordance with the invention, the linear spring 27 has the triangular configuration shown in FIG. 3 and is attached to the rear of the magnet side-piece by means of thru holes 35, 36 and rivets 37.

Figure 4C:
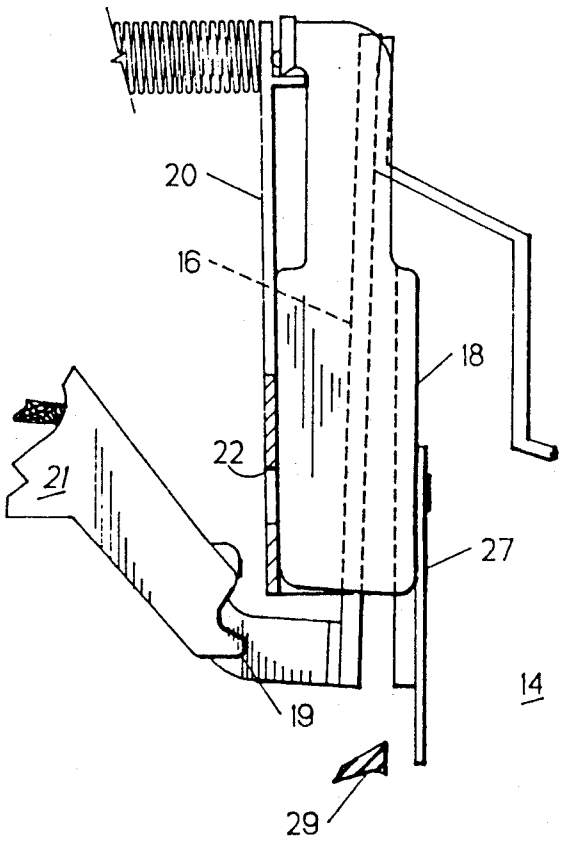
FIGS. 4A, 4B, and 4C are side views, in partial section of the thermal-magnetic trip unit of FIG. 1, depicting the displacement between the latching armature and the releasable element during overcurrent conditions.
Figure 4B:
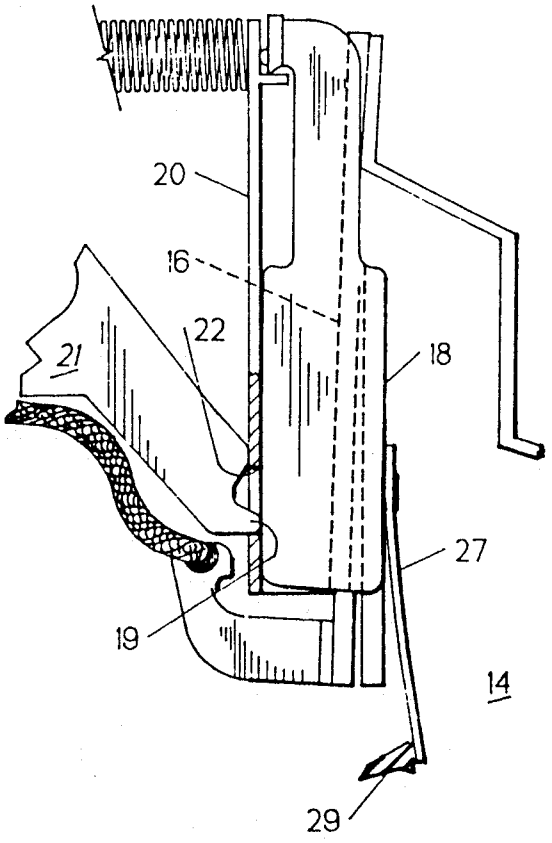
Figure 4A:
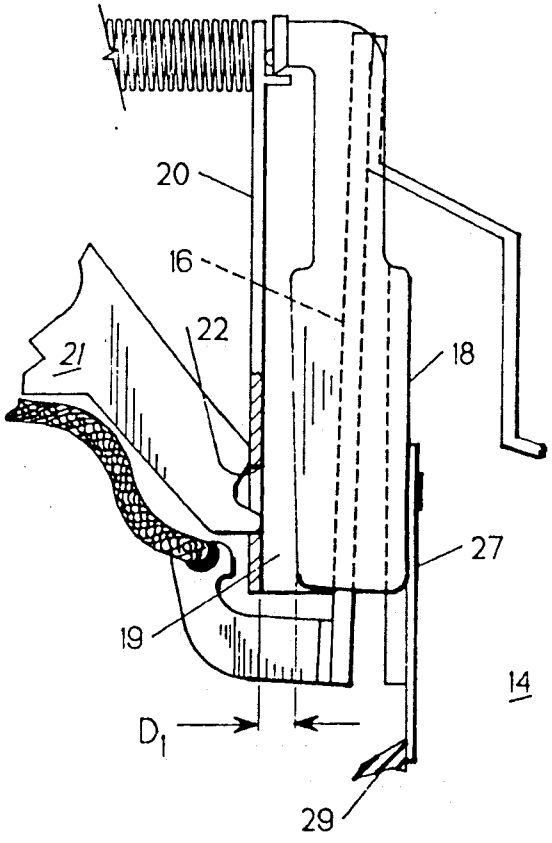

The operation of the trip unit 14 is best seen by referring now to FIGS. 4A-4C. In FIG. 4A the quiescent circuit current transporting through the bimetal 16 is insufficient to draw the magnet 18 in the direction of the latching armature 20 and deflect the attached linear spring 27 against the projection 29 formed on the bottom of the circuit breaker case. The magnetic gap separation distance is $D_1$ and the releasable element 21 is still retained by the latching armature by means of the hook 19 at the end of the releasable element supported within the rectangular slot 22. In FIG. 4B, further increase in the circuit current through the bimetal 16 draws the magnet 18 to the latching armature 20 causing the linear spring 27 to flex against the projection 29 and closes the magnetic gap. The force developed in spring 27 is now sufficient to pull the latching armature 20 away from the releasable element 21, as shown in FIG. 4C, allowing the hook 19 to fall from the rectangular slot 22 and to thereby articulate the circuit breaker operating mechanism and drive the circuit breaker contacts to their open position. When the circuit breaker operating mechanism is later reset, by re-engagement between the hook 19 and the rectangular slot 22, the thermal-magnetic trip unit 14 returns to the position indicated in FIG. 1 with the linear spring 27 lightly abutting against the projection 29 and with the magnetic gap separation distance again defined by $D_1$.

Figure 5:
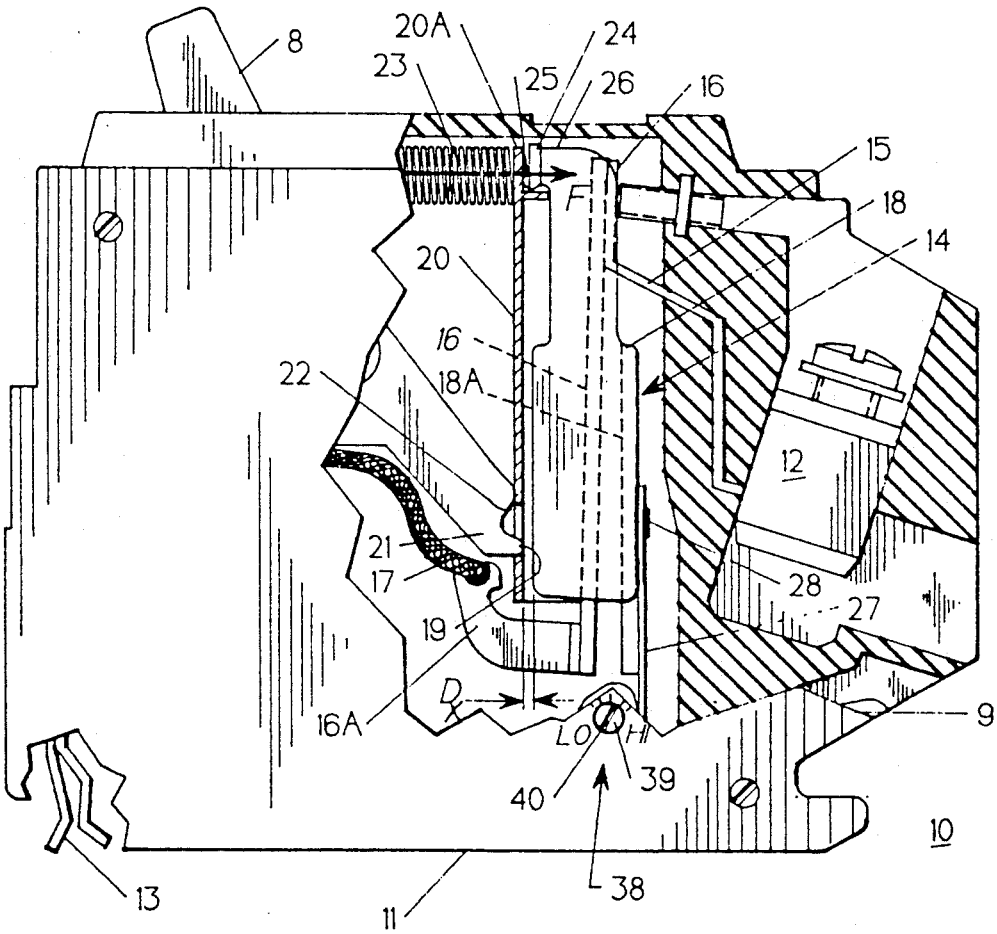
FIG. 5 is a side view of a residential circuit breaker with the cover partially removed to depict a further embodiment of the thermal-magnetic trip unit according to the invention.

The circuit breaker 10 depicted in FIG. 5 is similar to that described earlier in FIG. 1 and similar reference numerals will be used where possible. The current path through the circuit breaker proceeds from the load lug 12, through the load strap 15, bimetal 16, and braid conductor 17 in the same manner as described earlier. The releasable member 21 restrains the circuit breaker operating mechanism by means of the engagement between the hook 19 on the end of the releasable member and the rectangular slot 22 formed within the latching armature 20. The magnet 18 within the thermal-magnetic trip unit 14 includes a linear spring 27 that also functions in a similar manner to that described earlier with reference to FIG. 1. In place of a fixed stop 29 on the bottom of the circuit breaker housing case described earlier, the stop is now provided by a variable cam 38 that extends through the cover 9 and is externally adjustable over a wide range of magnetic gap separation distances by means of the rotatable dial 39 and screwdriver access slot 40. The magnetic gap separation distance $D_X$ defined between the latching armature 20 and the forward edge of the magnet 18 is now adjustable.

Figure 6B:
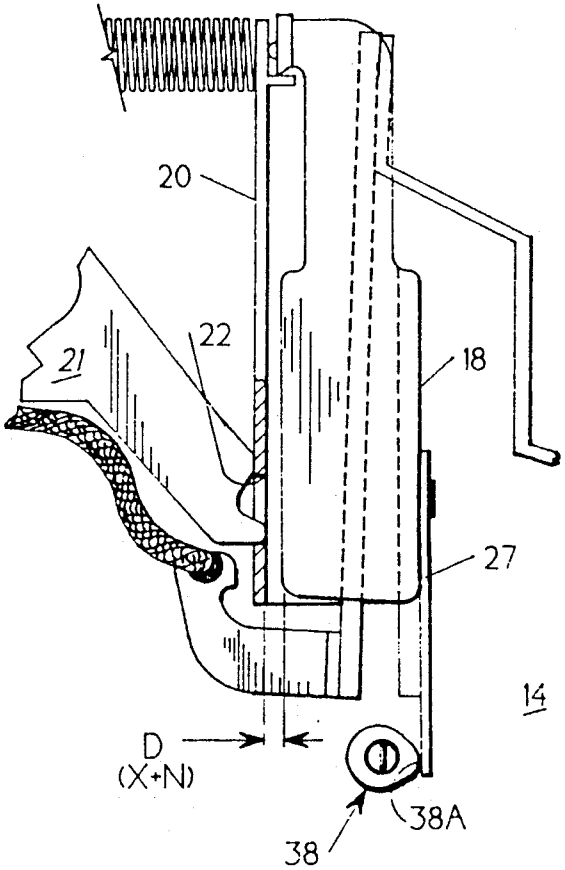
FIGS. 6A, 6B are side views of the thermal-magnetic trip unit within the circuit breaker of FIG. 5.
Figure 6A:
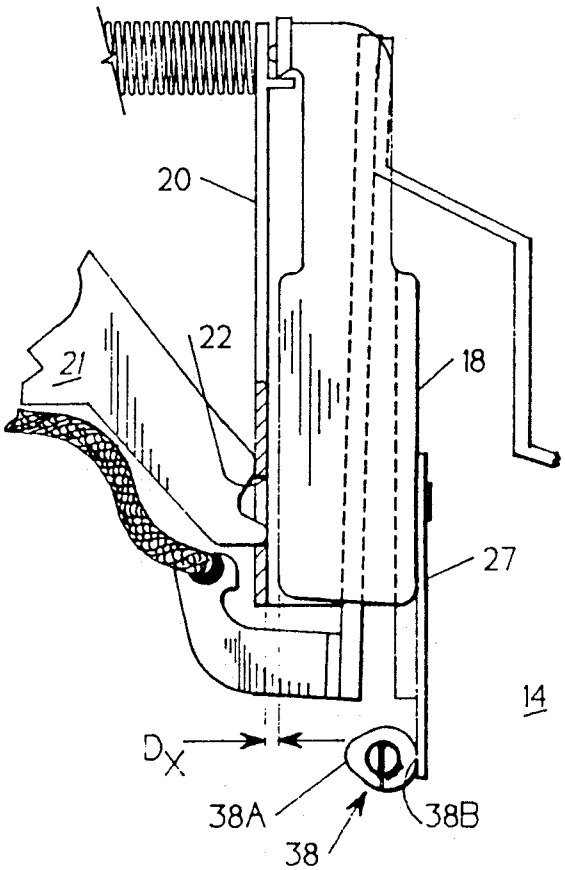

Referring now to FIGS. 6A, 6B, the thermal-magnetic trip unit 14 is depicted wherein the magnetic gap separation distance $D_X$ defined between the latching armature 20 and the forward edge of the magnet 18 is accurately controlled by the interaction between the linear spring 27 and the rotatable cam 38. The rotatable cam is eccentric in geometric cross-section and presents an elongated surface 38A on one side thereof with an opposing radial surface 38B on an opposite side thereof. In the configuration depicted in FIG. 6A, the radial surface 38B provides a minimum magnetic separation gap $D_X$ whereas in the configuration depicted in FIG. 6B the extended surface 38A contacts the linear spring 27 to thereby define a magnetic gap separation distance $D_X+N$ defined between the latching armature 20 and the forward edge of the magnet 18. The use of a rotatable cam to set the magnetic separation distance involves a variable adjustment of the magnetic gap separation distance by employing the linear spring 27 in cam-follower fashion whereby a slight rotation of the rotatable cam provides a corresponding change in the magnetic gap separation distance.

Figure 7:
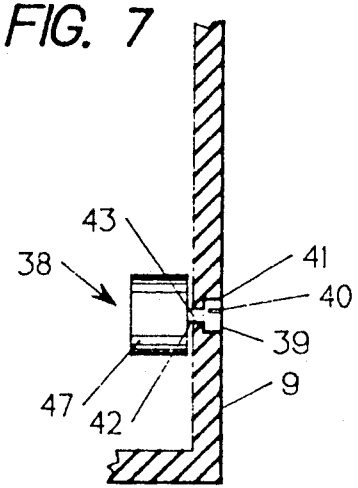
FIG. 7 is a side sectional view of a part of the circuit breaker enclosure of FIG. 5 depicting the adjustable cam used within the thermal-magnetic trip unit.

The rotatable cam 38 is depicted in FIG. 7 to show the arrangement of the cam assembly within the circuit breaker cover 9. A first opening 41 supports the externally accessible rotatable dial 39 which includes the screwdriver access slot 40. A second smaller opening 42 supports the neck 43 that joins the rotatable dial 39 to the body 47. The rotatable cam can be formed of a thermo-set or thermo-plastic material to ensure good electrical isolation between the externally accessible rotatable dial 39 and the linear spring 27.

Figure 8:
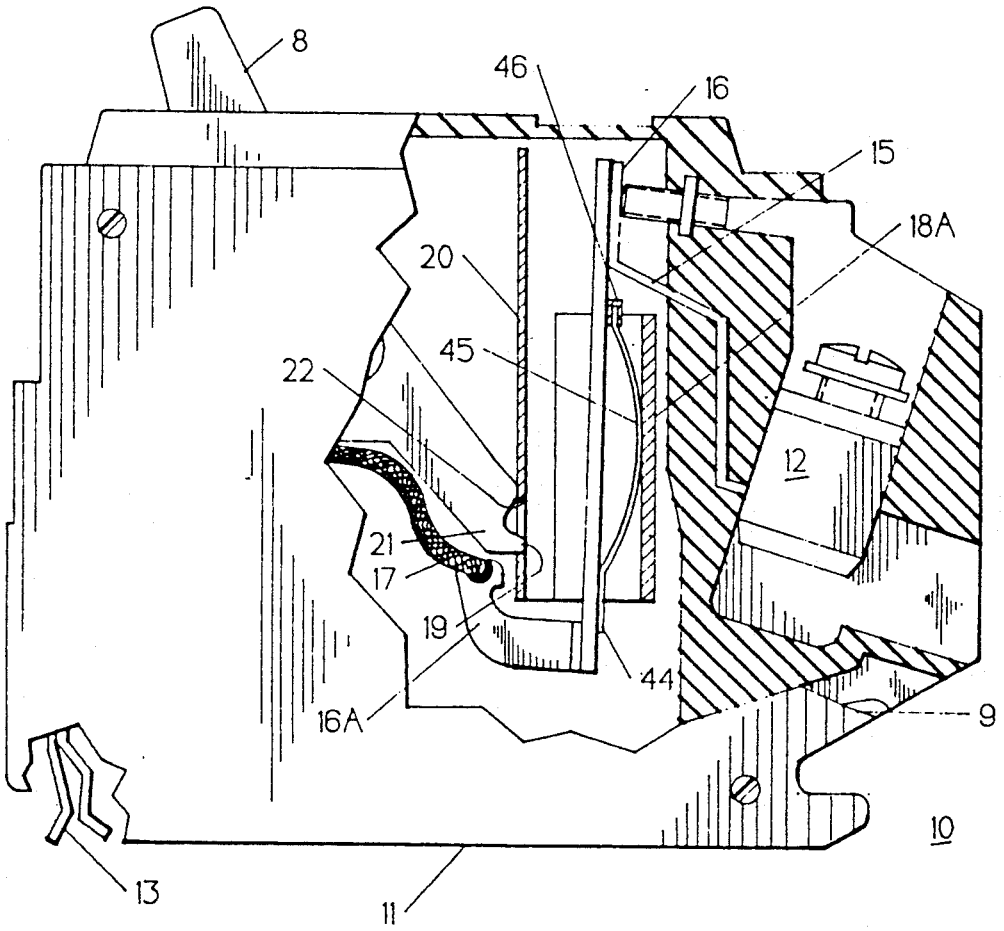
FIG. 8 is a side view of a residential circuit breaker with the cover partially removed to depict a still further embodiment of the thermal-magnetic trip unit according to the invention.

FIG. 8 shows a further embodiment of a circuit breaker 10 having low current magnetic response and operates in a manner similar to that described earlier with reference to FIGS. 1 and 5. The circuit current path extends between the load lug 12, load strap 15, bimetal 16, and braid conductor 17 out to the line terminal 13, as described earlier. The circuit breaker operating mechanism is constrained by a similar releasable element 21 having a hook 19 formed at one end and retained within the rectangular slot 22 formed at the bottom of the latching armature 20. The arrangement of the magnet differs from that described earlier by the attachment of a curvilinear spring 45 that is brazed or welded to the bottom of the bimetal as indicated at 44. In the rest position, that is, under zero circuit current through the bimetal, the arch of the spring sits against the inner surface of the magnet side-piece 18A. The opposite end of the curvilinear spring contacts the top part of the bimetal 16 through an insulated tube 46 to prevent short circuit of the current through the curvilinear spring under overcurrent conditions.

Figure 9A:
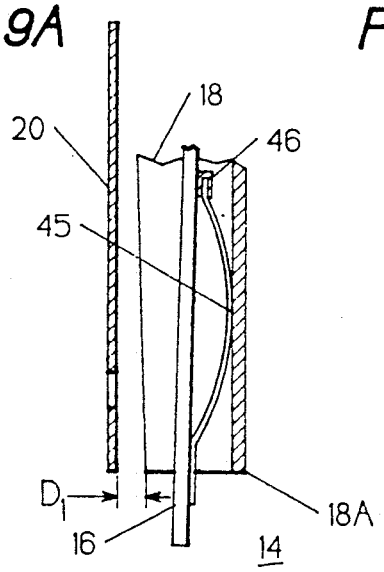
FIGS. 9A, 9B are side views, in partial section, depicting operation of the thermal-magnetic trip unit of FIG. 8.
Figure 9B:
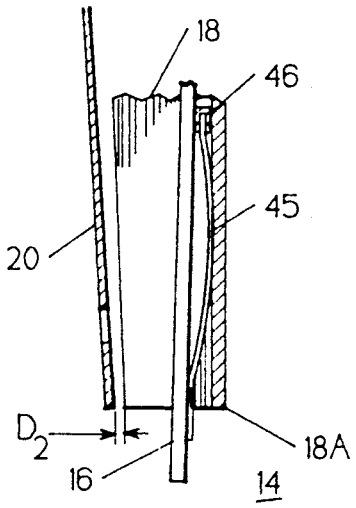

Referring now to FIGS. 9A, 9B, the thermal-magnetic trip unit 14 is depicted wherein under quiescent circuit current conditions through the bimetal 16, a magnetic separation gap distance $D_1$ is defined between the latching armature 20 and the forward edge of the magnet 18. The curvilinear spring 45 rests against the inner surface of the magnet side-piece 18A, as indicated. The provision of the curvilinear spring allows the magnet to move toward the latching armature 20 and yet allows the armature 20 to rotate away from the releasable element 21 of FIG. 8 due to the reverse bias provided between the bimetal 16 and the magnet 18. Upon the occurrence of an overcurrent condition through the bimetal, the magnet moves toward the latching armature and substantially reduces the magnetic gap separation to that depicted at $D_2$ in FIG. 9B. The magnetic forces generated between the magnet and the latching armature are now sufficient to drag the armature away from the releasable element, whereby the tension stored within the compressed curvilinear spring 45 rapidly drives the magnet 18 and the latching armature 20 to return the magnet to the position indicated at $D_1$ in FIG. 9A.

A number of thermal-magnetic trip units have herein been described wherein the magnet moves toward the latching armature to substantially increase the magnetic forces of attraction between the latching armature and the magnet. The low current magnetic response has been reduced to levels heretofore unobtainable without substantial modification or addition to the thermal-magnetic trip units.

Having thus described our invention, what we claim and desire to secure by Letters Patent is:

1. A thermal-magnetic trip unit for molded case circuit breakers comprising:

a thermally responsive electrically conductive element arranged for connection with a circuit breaker line or load strap;

a magnetically responsive element at least partially surrounding said electrically conductive element providing a magnetic force in proportion to circuit current through said electrically conductive element, said magnetically responsive element being arranged for movement in a first direction;

a latching armature positioned a predetermined separation distance from said magnetically responsive element to define a first magnetic separation gap, said latching armature arranged for retaining a circuit breaker releasable element under quiescent current through said electrically conductive element and releasing a circuit breaker releasable element under overload current through said electrically conductive element, said latching armature being pivotally arranged for rotation in a second direction opposite to said first direction; and a planar flexible element extending from said magnetically responsive element, said flexible element contacting a stop member upon said movement of said magnetically responsive element to thereby allow said magnetically responsive element to move further in said first direction thereby reducing said first magnetic separation gap and increasing said magnetic force when said circuit current increases above a predetermined value.

2. The trip unit of claim 1 wherein said flexible member comprises a spring.

3. The trip unit of claim 1 wherein said latching armature is pivotally attached to a top part of said magnetically-responsive element.

4. The trip unit of claim 3 wherein said magnetically responsive element includes a plate at one end, said plate including a projection interfacing with a top part of said latching armature.

5. The trip unit of claim 1 wherein said stop comprises a rotatable cam.

6. A low magnetic trip responsive circuit breaker comprising:

a circuit breaker enclosure;

a circuit breaker operating mechanism within said circuit breaker enclosure arranged for automatic interruption of circuit current upon occurrence of an overcurrent condition of predetermined magnitude and duration;

a releasable member attached to said operating mechanism restraining said operating mechanism under quiescent current conditions and articulating said operating mechanism upon occurrence of said overcurrent condition;

a thermally responsive electrically conductive element arranged for connection with a circuit breaker line or load strap to receive said circuit current;

a magnetically responsive element arranged within said circuit breaker enclosure, said magnetically responsive element at least partially surrounding said electrically conductive element and arranged for providing a magnetic force in proportion to circuit current transfer through said electrically conductive element;

a latching armature pivotally located a first distance from said magnetically responsive element to define a first magnetic separation gap, said latching armature arranged for retaining said circuit breaker releasable member under quiescent current through said electrically conductive element and releasing said releasable member upon transfer of said overcurrent through said electrically conductive element; and a planar flexible member attached to said magnetically responsive element and arranged for contacting a stop member and thereby allowing said magnetically responsive element to translate to a second distance from said latching armature to define a second magnetic separation gap smaller than said first magnetic separation gap.

7. The circuit breaker of claim 6 wherein said flexible member comprises a spring.

8. The circuit breaker of claim 6 wherein said stop comprises a projection extending from a bottom of said enclosure.

9. The circuit breaker of claim 6 wherein said stop comprises an adjustable cam.

10. The circuit breaker of claim 9 wherein a part of said cam projects outside said circuit breaker enclosure for external access.

11. The circuit breaker of claim 10 wherein said cam comprises an eccentric surface, one part of said surface extending further than another part.

12. The circuit breaker of claim 9 wherein said cam comprises a plastic base and a rotatable dial joined to said base by a plastic neck, said plastic dial arranged within a first opening in said enclosure and said neck arranged within a second opening smaller than said first opening.

13. The circuit breaker of claim 12 including a tool receiving slot formed on a top surface of said dial.

14. A thermal-magnetic trip unit for molded case circuit breakers comprising:

a thermally responsive electrically conductive element arranged for connection with a circuit breaker line or load strap;

a magnetically responsive element adapted for movement within a circuit breaker enclosure and at least partially surrounding said electrically conductive element providing a magnet force in proportion to circuit current through said electrically conductive element, said magnetically responsive element including a side-piece;

a latching armature positioned a predetermined separation distance from said magnetically responsive element to define a first magnetic separation gap, said latching armature arranged for retaining a circuit breaker releasable element under quiescent current through said electrically conductive element and releasing a circuit breaker releasable element under overload current through said electrically conductive element; and a planar flexible element having a first end attached to one end of said electrically conductive element and contacting an inner surface of said side-piece whereby said magnetically responsive element is biased a predetermined magnetic gap separation distance from said latching armature during quiescent circuit current through said electrically conductive element and moves toward said latching armature upon overcurrent circuit current through said electrically conductive element.

15. The thermal-magnetic trip unit of claim 14 wherein a second end of said flexible element contacts an opposite end of said electrically conductive element.

16. The thermal-magnetic trip unit of claim 15 including an electrically insulative sleeve arranged over said second end of said flexible element to deter transfer of current through said flexible element.

17. The thermal-magnetic trip unit of claim 14 wherein said flexible element comprises an arcuate configuration.

18. A low magnetic trip responsive circuit breaker comprising:

a circuit breaker enclosure;

a circuit breaker operating mechanism within said circuit breaker enclosure arranged for automatic interruption of circuit current upon occurrence of an overcurrent condition of predetermined magnitude and duration;

a releasable member attached to said operating mechanism restraining said operating mechanism under quiescent current conditions and articulating said operating mechanism upon occurrence of said overcurrent condition;

a thermally responsive electrically conductive element arranged for connection with a circuit breaker line or load strap to receive said circuit current;

a magnetically responsive element arranged within said circuit breaker enclosure, said magnetically responsive element at least partially surrounding said electrically conductive element and arranged for providing a magnetic force in proportion to circuit current transfer through said electrically conductive element;

a latching armature pivotally arranged a first separation distance from said magnetically responsive element to define a first magnetic gap, said latching armature arranged for retaining said circuit breaker operating cradle under quiescent current through said electrically conductive element; and a planar flexible member having a first end attached to one end of said electrically conductive element and contacting a part of said magnetically responsive element to bias said magnetically responsive element to said first separation distance.

19. The circuit breaker of claim 18 wherein a second opposite end of said flexible element contacts an opposite end of said electrically conductive element through an electrical insulator.

20. The circuit breaker of claim 18 wherein said flexible element defines an arcuate configuration.

21. The circuit breaker of claim 20 wherein said flexible element becomes compressed between said magnetically responsive element and said electrically conductive element when said magnetically responsive element moves toward said latching armature under overload circuit current.

22. The circuit breaker of claim 21 wherein said comprised flexible element drives said latching armature and said magnetically responsive element away from releasable member to thereby articulate said circuit breaker operating mechanism during said overload circuit current.

* * * * *